US008888222B2

(12) United States Patent
Ito

(10) Patent No.: US 8,888,222 B2
(45) Date of Patent: Nov. 18, 2014

(54) LIQUID EJECTION APPARATUS THAT RECOVERS EJECTION PERFORMANCE SUITABLY BASED ON A TIME INTERVAL BETWEEN ONE IMAGE FORMATION AND ANOTHER IMAGE FORMATION

(75) Inventor: Yuichi Ito, Mie-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 345 days.

(21) Appl. No.: 13/431,843

(22) Filed: Mar. 27, 2012

(65) Prior Publication Data

US 2013/0083113 A1 Apr. 4, 2013

(30) Foreign Application Priority Data

Sep. 30, 2011 (JP) ..... 2011-215852

(51) Int. Cl.
*B41J 29/38* (2006.01)
*B41J 2/165* (2006.01)

(52) U.S. Cl.
CPC ..... *B41J 2/165* (2013.01); *B41J 2/1652* (2013.01)
USPC ..... 347/16

(58) Field of Classification Search
None
See application file for complete search history.

(56) References Cited

U.S. PATENT DOCUMENTS

| | | | | |
|---|---|---|---|---|
| 6,193,351 | B1 * | 2/2001 | Yaegashi et al. | 347/23 |
| 6,338,540 | B1 * | 1/2002 | Hasegawa et al. | 347/23 |
| 6,796,633 | B1 | 9/2004 | Kawamata et al. | |
| 2001/0005210 | A1 * | 6/2001 | Suzuki | 347/35 |
| 2005/0078145 | A1 * | 4/2005 | Inoue | 347/31 |
| 2005/0219285 | A1 * | 10/2005 | Inoue | 347/9 |
| 2008/0186344 | A1 | 8/2008 | Hara | |
| 2009/0066737 | A1 * | 3/2009 | Sakurai | 347/9 |

FOREIGN PATENT DOCUMENTS

| | | | |
|---|---|---|---|
| EP | 0879701 | A2 | 11/1998 |
| EP | 1013436 | A2 | 6/2000 |
| EP | 1205307 | A2 | 5/2002 |
| JP | H11-314378 | A | 11/1999 |
| JP | 2002-052740 | A | 2/2002 |
| JP | 2005-280248 | A | 10/2005 |
| JP | 2008-296563 | A | 12/2008 |

OTHER PUBLICATIONS

European Patent Office, extended European Search Report for European Patent Application No. 12161500.9 (counterpart European patent application), dated Nov. 21, 2012.

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A liquid ejection apparatus includes a liquid ejection head, a conveyor, a recording controller, and a flashing controller. The conveyor conveys a recording medium along a conveyance path. The recording controller causes the conveyor to convey a recording medium, and controls liquid ejection from the liquid ejection head to form an image on the recording medium based on image data. The flashing controller causes the conveyor to temporarily stop conveyance of the recording medium, and causes liquid injection from the liquid ejection head based on drive data which is unrelated to image formation. The flashing controller determines timing for executing a subsequent flashing control on that, within a print enforceable period between one flashing control and the subsequent flashing control, the number of pages subjected to image formation based on image data increases with a decrease in time interval between image formation on one page and on another page.

17 Claims, 11 Drawing Sheets

LIQUID EJECTION APPARATUS THAT RECOVERS EJECTION PERFORMANCE SUITABLY BASED ON A TIME INTERVAL BETWEEN ONE IMAGE FORMATION AND ANOTHER IMAGE FORMATION

CROSS-REFERENCE TO RELATED APPLICATION

The present application claims priority from Japanese Patent Application No. 2011-215852, which was filed on Sep. 30, 2011 the disclosure of which is herein incorporated by reference in its entirety.

BACKGROUND OF THE INVENTION

1. Field of the Invention

The present invention relates to a liquid ejection apparatus having a liquid ejection head.

2. Description of the Related Art

When a recording process is executed continuously to a recording medium, the viscosity of a liquid in the liquid ejection head increases, which may cause deterioration in the recording quality. To prevent deterioration of the recording quality, there is pre-ejection which eject the liquid from the liquid ejection head before executing a recording process. There has been a traditional technology which pre-ejection of a larger ejection amount than ordinary pre-ejection is selected based on a determining condition such as the number of copies, the printing intervals, or the like, thereby effectively recovering the ejection performance. One possible approach is to execute a process of recovering the ejection performance of the head when a certain condition such as the number of copies, the printing intervals, or the like is met.

SUMMARY OF THE INVENTION

When the time interval between image formation on one page and that on another page is relatively short, the recording process is executed with respect to many recording media in a short time. In this case, the liquid is frequently ejected from the head. Therefore, the viscosity of the liquid hardly increases, and it is less likely that the recording quality is deteriorated. If, despite this fact, ejection performance is recovered based on the number of copies or the printing intervals without variation, the process of recovering the ejection performance may be executed once a pre-set number of copies or printing interval has been reached, even though the recording quality, has not yet been significantly deteriorated. This could be a waste of the liquid or the power.

In view of the above problem, an object of the present invention is to provide a liquid ejection apparatus capable of executing the process of recovering, the ejection performance suitably based on the time interval between one image formation and another image formation.

A liquid ejection apparatus, includes a liquid ejection, a conveyor, a according controller, and a flashing controller. The liquid ejection head ejects a liquid. The conveyor conveys one or more recording media along a conveyance path. The recording controller causes the conveyor to convey the recording media, and executes control for ejecting the liquid from the liquid ejection head so that an image is formed on the recording media based on image data. The flashing controller executes flashing control for causing the conveyor to temporarily stop conveyance of the recording media, and for causing liquid ejection from the liquid ejection head, based on drive data which is not related to image formation. The flashing controller determines timing for executing a subsequent flashing control so that, within a print enforceable period between one flashing control and the subsequent flashing control, the number of pages subjected to image formation based on image data increases with a decrease in a time interval between image formation on one page and that on another page.

A liquid ejection apparatus includes an ejection head a paper sensor, a conveyance mechanism, and a control unit. The ejection head ejects ink droplets. The paper sensor detects a leading end of a sheet on which an image is to be formed. The conveyance mechanism conveys the sheet from a predetermined position where the paper sensor is disposed to an image formation area facing the ejection head. The control unit includes a recording controller which synchronizes conveyance of the sheet by the conveyance mechanism with ejection of ink from the ejection head, based on a signal from the paper sensor, and a flashing controller which performs flashing control to temporarily stop the conveyance of the sheet by the conveyance mechanism, and then eject ink from the ejection head while no sheet is disposed in a position where ink will be placed. The recording controller causes the conveyance mechanism to successively convey a plurality of the sheets, and causes image formation on each sheet by ejecting ink from the ejection head based on image data. Every time the paper sensor detects the leading end of a sheet, the flashing controller derives a product by multiplying a time interval between the sheet and a previous sheet having passed the predetermined position by a coefficient corresponding to the time interval, which is set so as to decrease with a decrease in the time interval performs addition using the product thus derived, and performs flashing control when added value resulting from the addition of the product exceeds a threshold.

DESCRIPTION OF THE PREFERRED EMBODIMENTS

The following describes a preferable embodiment of the present invention with reference to the attached drawings.

Figure 1:
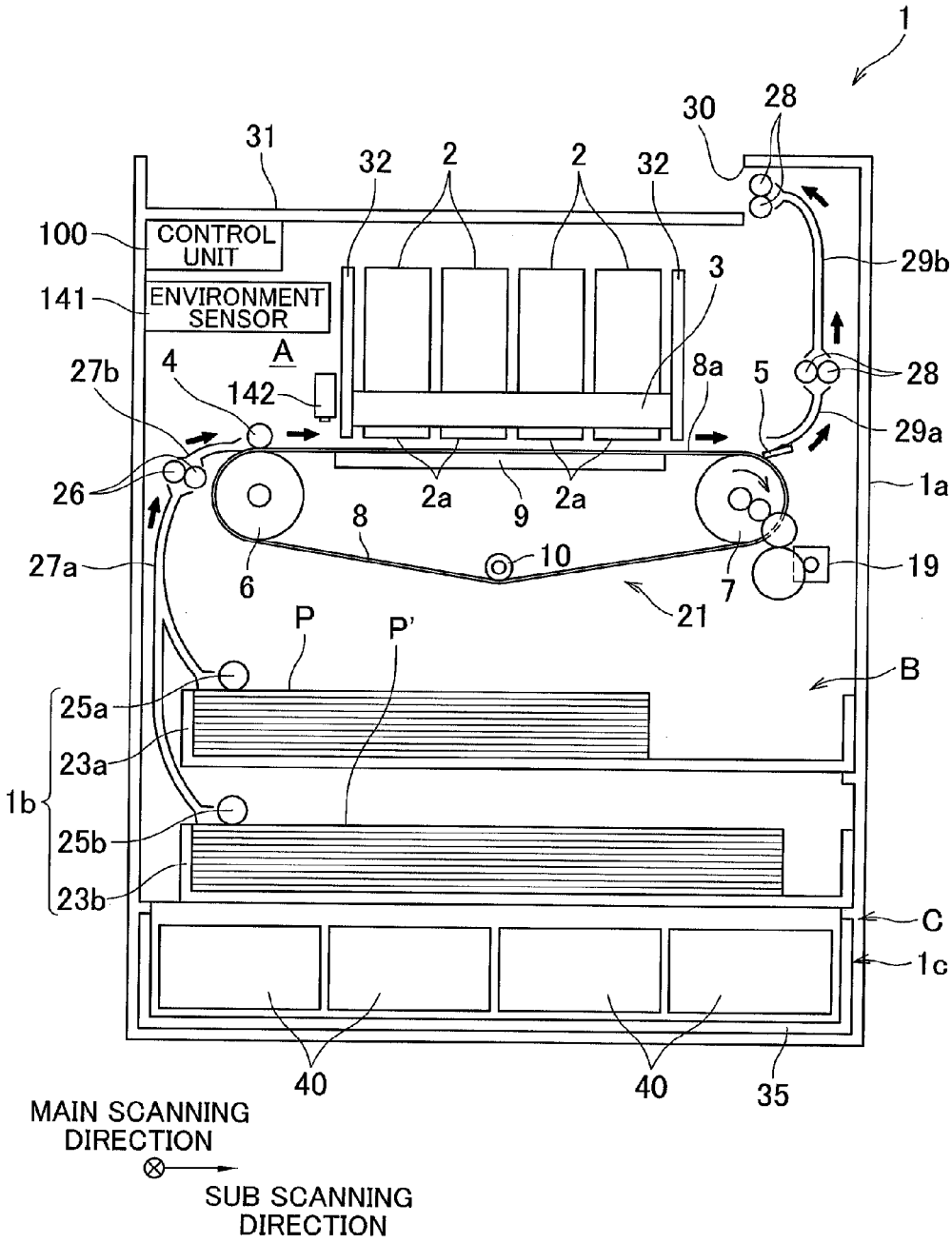
FIG. 1 is a schematic side view showing an internal structure of an ink-jet printer to which an ink-jet head related to a first embodiment which is one embodiment of the present invention is applied.
Figure 2:
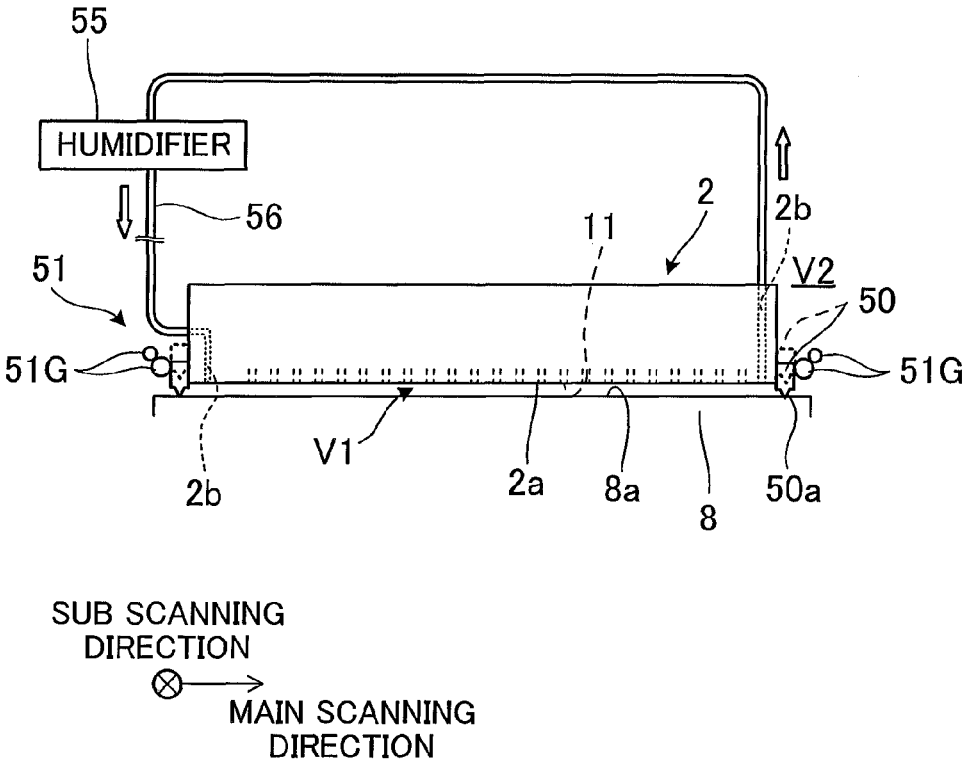
FIG. 2 is a side view of a cap unit covering an ejection face of the ink-jet head shown in FIG. 1.

First, the following describes an overall structure of an ink-jet printer 1 related to a first embodiment of the present invention, with reference to FIG. 1 and FIG. 2.

The printer 1 has a casing 1*a* having a rectangular parallelepiped shape. At an upper portion of the casing 1*a* is provided a sheet output unit 31. In the following description, the inside space of the casing 1*a* is parted into space A, B, and C in this order from the top. The spaces A and B have a conveyance path connecting to the sheet output unit 31. In the space A, conveyance of a sheet P or P', and image recording on the sheet P or P' take place. In the space B, an operation related to sheet feeding takes place. In space C are accommodated ink cartridges 40 each serving as an ink supply source.

In the space A are disposed four ink-jet heads 2 (hereinafter, heads 2), cap units 50 which cover the ejection faces 2*a* of the heads 2 respectively, a conveyance unit 21 which conveys the sheet P or P', a guide unit which guides the sheet P or P', or the like. In the space A if further disposed a control unit 100 which administrates all the operations of the printer 1 by controlling an operation of each part of the printer 1 including the above mentioned mechanisms. Further, an environment sensor 141 is installed which detects an environmental condition inside the printer 1. The environment sensor 141 has a temperature sensor and a humidity sensor. The detection result from the environment sensor 141 is input to the control unit 100.

The control unit 100 controls recording-related operations such as preparation, feeding/conveyance/output operations of the sheet P or P', and an ink ejection operation synchronized with the conveyance of the sheet P or P' so that an image is formed on the sheet P or P' based on print job data supplied from the outside. The print job data contains image data indicating an image to be formed on the sheet P.

Figure 5A:
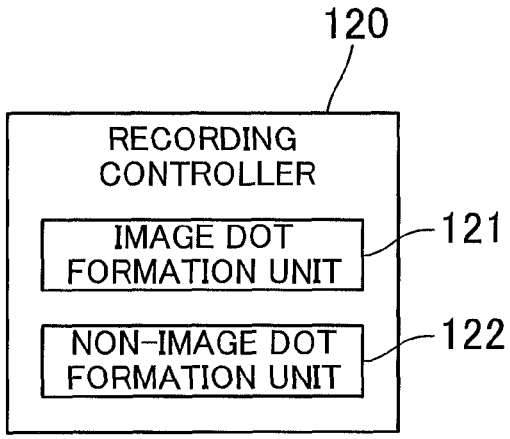
FIG. 5A is a block diagram showing detailed structure of a recording controller of FIG. 4.

The control unit 100 includes, in addition to a CPU (Central Processing Unit) serving as a calculation process apparatus, a ROM (Read Only Memory), a RAM (Random Access Memory: encompassing non-volatile RAM), an ASIC (Application Specific Integrated Circuit), an I/F (Interface), an I/O (Input/Output Port), or the like. The ROM stores a program to be run by the CPU, various types of fixed data, or the like. The RAM temporarily stores data such as image data needed when running the program. In the ASIC, signal processing or image processing such as alteration of the image data, realignment, or the like. The I/F performs data communication with a higher-level device. The I/O performs input/output of sensor signals from various sensors. The structure of the later-described control system shown in FIG. 5 and FIG. 6 are realized by hardware in cooperation with software stored in the ROM, or the like. Alternatively, it is possible to provide as needed a circuit or the like exclusively specialized for the function of any of the functional parts shown in FIG. 5 and FIG. 6.

As shown in FIG. 1, the conveyance unit 21 includes: belt rollers 6, 7; an endless conveyor belt 8 looped about the both rollers 6, 7; a nip roller 4 and a separation plate 5 disposed outside the loop of the conveyor belt 8; a platen 9 and a tension roller 10 disposed inside the loop of the conveyor belt 8.

The belt roller 7 is a drive roller which is driven by conveyance motor 19 to rotate clockwise in FIG. 1. With rotation of the belt roller 7, the conveyor belt 8 runs in a direction of the bold arrow in FIG. 1. The belt roller 6 is a driven roller which rotates clockwise in FIG. 1, with movement of the conveyor belt 8. The nip roller 4 is disposed to face the belt roller 6, and presses a sheet P or P' supplied from a later-described upstream guide against an outer circumference 8*a* of the conveyor belt 8. The separation plate 5 is dispose to face the belt roller 7, and separates the sheet P or P' from the outer circumference 8*a* and guides the sheet P or P' to a later-described downstream guide. The platen 9 is dispose to face the four heads 2 and supports the upper part of the loop of the conveyor belt 8. The tension roller 10 biases downwards the lower part of the loop of the conveyor belt 8.

The guide unit includes the upstream guide and the downstream guide which are disposed to sandwich therebetween the conveyance unit 21. The upstream guide includes two guides 27*a*, 27*b* and a pair of feed rollers 26 and connects a later-described sheet-feeder unit 1*b* to the conveyance unit 21. The downstream guide includes two guides 29*a*, 29*b* and two pairs of feed rollers 28, and connects the conveyance unit 21 to the sheet output unit 31.

Each of the heads 2 is a line head having substantially rectangular parallelepiped shape which is long in the main scanning direction. The head 2 includes a passage unit 12 and eight actuator units 17 (see FIG. 3). When recording an image, the respective under surfaces of the four heads 2, i.e., ejection faces 2*a*, eject ink of Magenta, Cyan, Yellow, and Black, respectively. The specific structure of each head 2 is detailed later. The four heads 2 are aligned in the sub scanning direction at a predetermined pitch, and are fixed to a head frame 3.

The head frame 3 is supported by a head moving unit 32 and is moveable in up/down directions. The head moving unit 32 includes a drive motor and rack and pinion or the like which communicates the rotation drive force from the drive motor to the head frame 3, and moves the heads 2 in up/down directions via the head frame 3. Thus, the heads 2 are selectively positioned in a record position and a retracted position, the record position being a position such that a predetermined space suitable for image recording is formed between the heads 2 and the outer circumference 8*a* of the conveyor belt 8, the retracted position being higher than the record position.

The paper sensor 142 is disposed upstream from the head frame 3 relative to a later-described conveyance path. The paper sensor 142 detects whether a leading end of a sheet has passed on the conveyor belt 8, and transmits the detection result to the control unit 100. This detection result is, as described later, used for the control unit 100 to reliably synchronize ink ejection from the heads 2 with the sheet conveyance.

The head frame 3 is provided with cap units 50 each of which surrounds the lower end of the outer periphery of the head 2, as shown in FIG. 2. The cap unit 50 is made of an elastic material such as rubber, and has an annular shape which surrounds the outer periphery of the ejection face 2*a* in plan view. At the lower end of the cap unit 50 is formed a projection 50*a* having a cross section in a reverse triangle shape.

The cap unit 50 is moveable up and down by the cap moving unit 51. The cap moving unit 51 has a plurality of gears 51*g* and a drive motor for driving these gears 51*g*. Driving these gears 51*g* causes the cap unit 50 to move up and down in vertical directions. With this movement in up and down directions, the cap unit 50 is positioned in an ascended position or a descended position, the ascended position being:

position where the projection 50*a* is positioned higher than the ejection face 2*a*, the descended position being a position where the projection 50*a* is positioned lower than the ejection face 2*a*. The ascended position is shown in broken lines, while the descended position is shown in solid lines. When the cap unit 50 is disposed in the descended position while the head 2 is in the record position, the projection 50*a* abuts the outer circumference 8*a* of the conveyor belt 8 as shown in FIG. 2.

The control unit 100, particularly a later-described head protection control unit 104, controls a cap moving unit 51 so that the cap unit 50 is in the descended position during a capping state, and in the ascended position during a non-capping state. During the capping state, the edge of the projection 50*a* abuts the outer circumference 8*a*, thereby sealing off the ejection face 2*a* as shown in FIG. 2. In other words, a sealed space V1 formed between the ejection face 2*a* and the surface 8*a* is isolated from an external space V2. This restrains drying up of the ink nearby the ejection openings 1 of the ejection face 2*a*. When the control unit 100 controls the cap moving unit 51 so that the cap unit 50 is in the ascended position, the sealed space V1 is opened to the external space V2.

In the space B is disposed a sheet-feeder unit 1*b*. The sheet-feeder unit 1*b* includes: sheet-feeder trays 23*a* and 23*b*, and sheet-feeding rollers 25*a* and 25*b*. The sheet-feeder tray 23*a* accommodates the sheet P having a predetermined length in the longitudinal direction, i.e., the length direction. The sheet-feeder tray 23*b* accommodates a sheet P' which is longer than the sheet P in the longitudinal direction. The sheet-feeder trays 23*a* and 23*b* are all detachable with respect to the casing 1*a*. The sheet-feeder trays 23*a* and 23*b* are a box whose top is opened. The sheet-feeding roller 25*a* sends out the uppermost sheet P in the sheet-feeder tray 23*a*, and supplies the sheet P to the upstream guide. The sheet-feeding roller 25*b* sends out the uppermost sheet P' in the sheet-feeder tray 23*b*, and supplies the sheet P' to the upstream guide.

As hereinabove mentioned, in the spaces A and B, the conveyance path is formed which extends from the sheet-feeder unit 1*b* to the sheet output unit 31 via the conveyance unit 21. When the control unit 100 drives the sheet-feeding roller 25*a* or 25*b*, the feed rollers 26, 28, the conveyance motor 19, or the like, based on a record command, the sheet P is fed from the sheet-feeder tray 23*a* or 23*b*. The sheet P is supplied to the conveyance unit 21 by the feed roller 26. When the sheet P passes immediately under each head 2 in the sub scanning direction, each ejection face 2*a* ejects ink, thereby recording a color image on the sheet P. The sheet P is then separated by the separation plate 5, and conveyed upward by two feed rollers 28. Further, the sheet P is output to the sheet output unit 31 from the opening 30 in the upper portion. As described, the feed rollers 26, 28 and the conveyance unit 21 corresponds to the conveyor of the present invention. Note that the sub scanning direction is a direction parallel to the conveyance direction of the sheet P by the conveyance unit 21, and the main scanning direction is a direction parallel to the horizontal plane and orthogonal to the sub scanning direction.

In the present embodiment, a plurality of types of recording modes are selectable. Table 1 is an example in which three recording modes are adopted. These recording modes are different from one another in the conveyance speed. In the mode A, the sheet P or P' is conveyed so that the printing interval is t1. In the mode B, the sheet P or P' is conveyed so that the printing interval is t2. In the mode C, the sheet P or P' is conveyed so that the printing interval is B. These printing intervals have a relation such that; t1<t2<t3. The printing interval t is, for example, a time interval between a printing start point on a sheet P and a printing start point on a subsequent sheet P. Further, the printing interval t corresponds to a time interval of detecting the sheet leading ends by the paper sensor 142.

TABLE 1

| | Recording mode | | |
|---|---|---|---|
| | Mode A | Mode B | Mode C |
| Printing interval (time) | t1 | t2 | t3 |

In the space C is disposed an ink unit 1*c* which is detachable with respect to the casing 1*a*. The ink unit 1*c* includes a cartridge tray 35, and four cartridges 40 aligned in the tray 35. Each cartridge 40 supplies ink to the head 2 via an ink.

Figure 3:
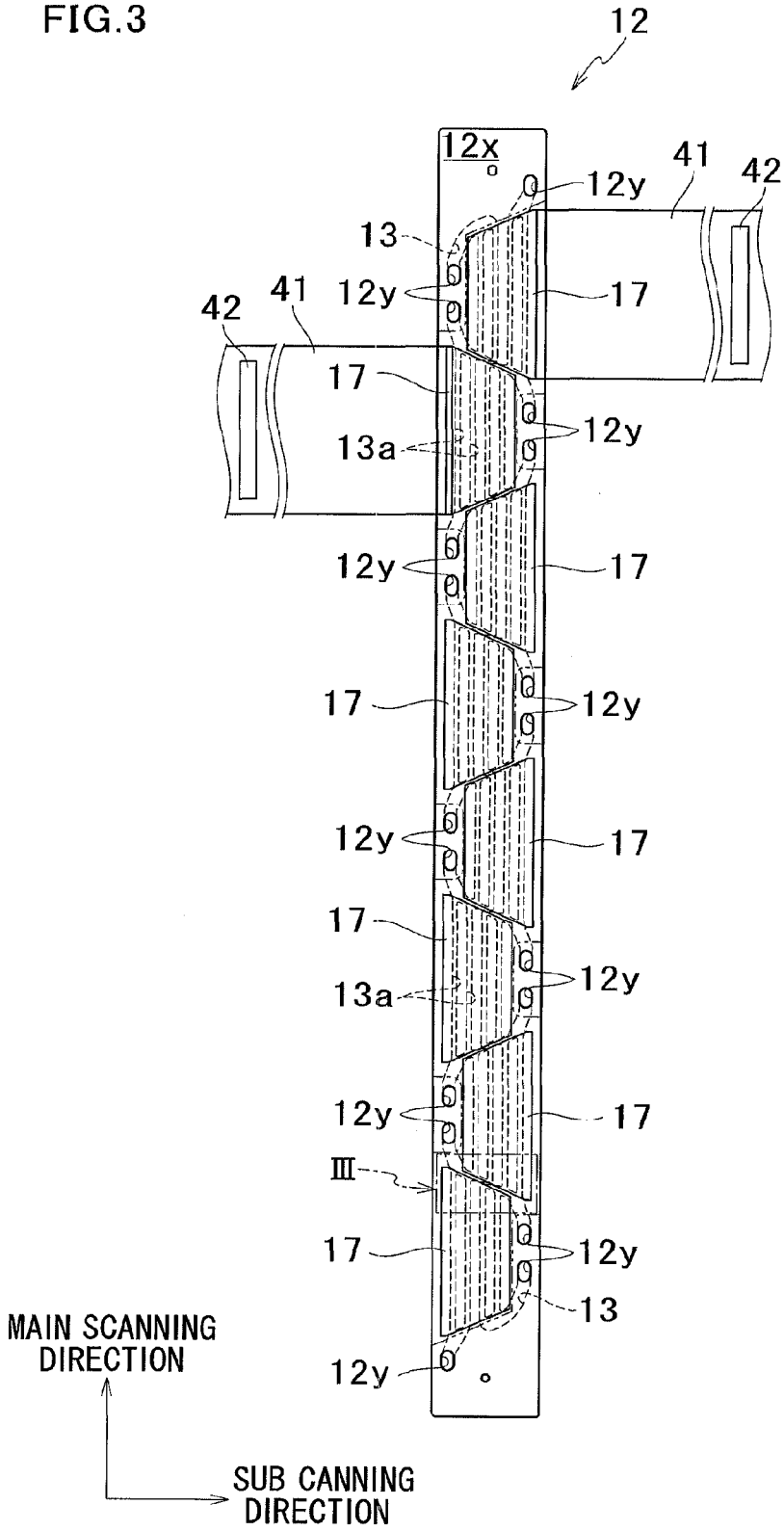
FIG. 3 is a plan view of a passage unit structuring a lower structure of the ink-jet head.

Next, with reference to FIG. 2 and FIG. 3, the following details the structure of each head 2 and the peripheral mechanisms. In the present embodiment, a humidifying mechanism is a peripheral mechanism. As shown in FIG. 2, the humidifying mechanism includes, in addition to the cap unit 50, a humidifier 55, an air tube 56, two air passages 2*b*. The humidifier 55 generates humid air and feeds the air in one direction. The air tube 56 connects the humidifier 55 to the sealed space V1 created by the cap unit 50 in such a manner that the humid air is circulated. The air passage 2*b* is disposed along a side wall of the lower structure of the head 2 and is in communication with the sealed space V1. To the outer end of the air passage 2*b* is connected the head-side end of the air tube 56. When humidifying, the humid air flows along the arrow shown in the figure.

The head 2 has the upper structure which function as an ink reservoir and a lower structure to which the ink is supplied from the upper structure. In the upper structure is stored ink supplied from the cartridge 40. As shown in FIG. 3, the lower structure has a passage unit 12 and actuator units 17. On a top surface 12*x* of the passage unit 12 is formed openings 12*y*. The ink from the upper structure flows into the passage unit 12 through the openings 12*y*. The under surface of the passage unit 12 is the ejection face 2*a*. The ejection face 2*a* has a plurality of ejection opening 11 (see FIG. 2) which eject ink. Inside the passage unit 12 is formed an ink passage connecting the openings 12*y* to the ejection openings 11. As shown in FIG. 3, the ink passage includes manifold channels 13 each having one end being the opening 12*y*, sub manifold channels 13*a* which branched off from the manifold channel 13, and individual ink passages each extending from an outlet of any one of the sub manifold channels 13*a* to the ejection opening 11.

On the top surface 12*x* of the passage unit 12 are pasted eight actuator units 17. As shown in FIG. 3, the actuator units 17 has a trapezoidal plane shape, and is disposed in a zigzag manner in two rows on the top surface 12*x*. The control unit 100, the driver IC 42, and each actuator unit 17 are connected with one another via FPC 41. To the actuator unit 17 is supplied drive signals from the driver IC 42, based on a control command from the control unit 100.

The FPC 41 is a flat flexible substrate which is provided for each actuator unit 17, and has a driver IC 42 mounted thereon. When a drive signal is supplied from the driver IC 42, the actuator unit 17 applies a pressure individually to the ink inside the individual ink passages. This causes ejection of the ink inside the individual ink passages from the ejection openings 11.

The following details the structure of the control unit 100 with reference to FIG. 4 to FIG. 8. First described is a structure for performing control to form an image on the sheet P or P' based on image data.

Figure 4:
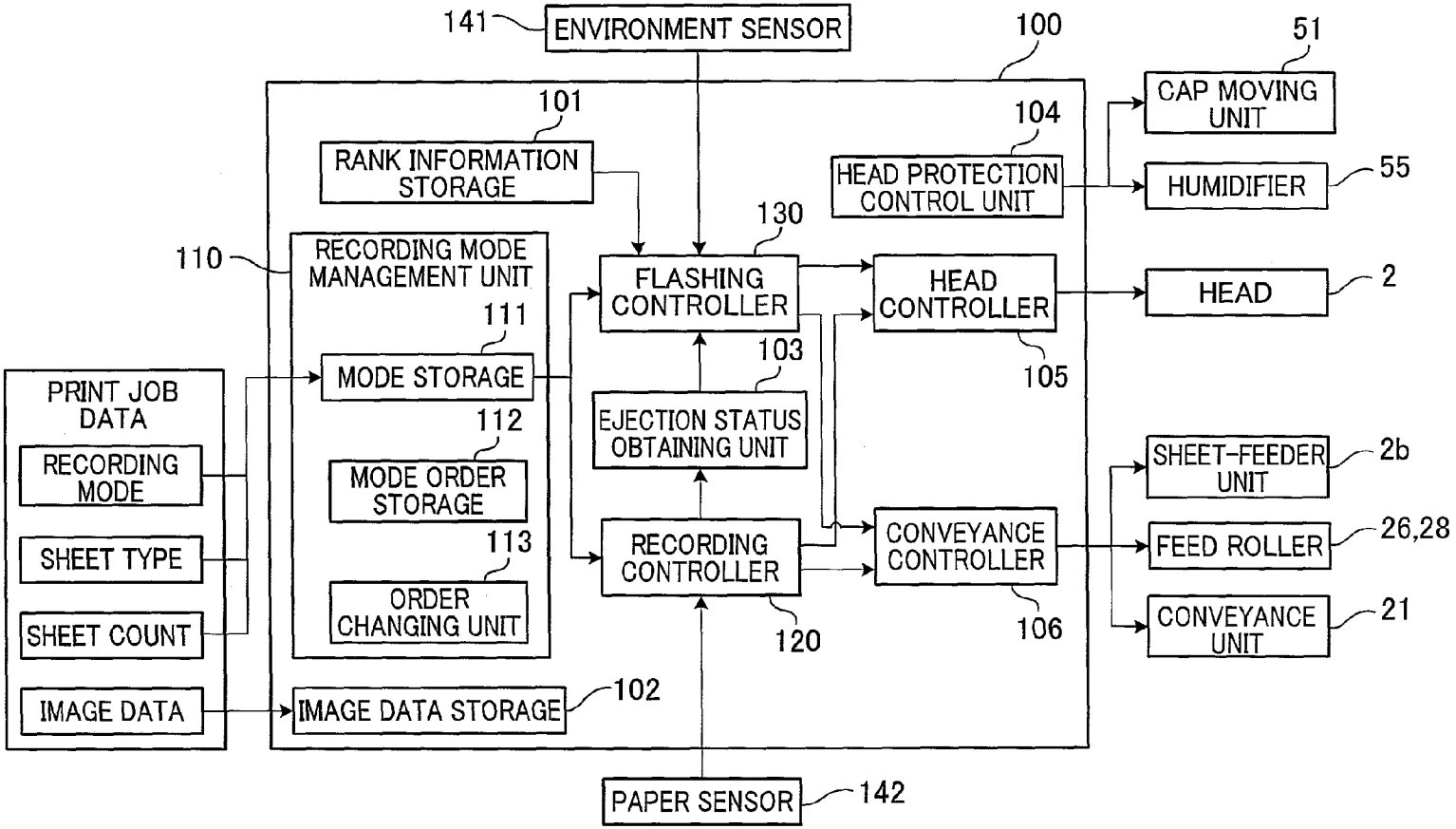
FIG. 4 is a block diagram showing a structure of a control system.

As shown in FIG. 4, the control unit 100 has as a structure for controlling image formation an image data storage 102, a recording mode management unit 110, a recording controller 120, a head controller 105, and a conveyance controller 106. When print job data is supplied from an external source, image data contained in the job is stored in the image data storage 102. The print job data contains, in addition to the image data, data indicative of printing conditions designated by a user in the printing job. This data (hereinafter, condition data) contains recording mode data, sheet type data, and sheet count data, or the like. The recording mode data instructs one of the modes A to C (see Table 1). The sheet type data instructs which one of the sheets P and P' is to be used. The sheet count data instructs the number of sheets to be subjected to image formation.

The recording mode management unit 110 has a mode storage 111. The above mentioned condition data is stored in the mode storage 111 in association with the image data. The control unit 100, when a plurality of sets of print job data are received, the control unit 100 stores the sets of data to the image data storage 102 and the mode storage 111, in an order of receiving these sets of print jobs. The recording mode management unit 110 has a mode order storage 112, and stores therein an order corresponding to the order of storing the recording modes or the like (see FIG. 8).

The recording controller 120 controls image formation based on the condition data and the image data. The recording controller 120 reads out the condition data and the image data from the mode storage 111 and the image data storage 102, respectively, in an order according to the order data stored in the mode order storage 112. Based on the condition data and the image data thus read out, a control command is transmitted to the head controller 105 and the conveyance controller 106.

The control command from the recording controller 120 to the conveyance controller 106 instructs conveyance of the sheet P or P' according to the sheet type data, in number according to the sheet count data, at a speed corresponding to the recording mode, i.e., at the time intervals corresponding to the recording mode. The conveyance controller 106 follows this control command and controls the sheet-feeder unit 1*b*, the feed rollers 26, the conveyance unit 21, and the feed rollers 28.

The control command from the recording controller 120 to the head controller 105 instructs ejection of ink droplets from the ejection openings 11 to form an image on a sheet in a predetermined order. The image is structured by image dots based on the image data and non-image dots based on on-paper flashing data. The head controller 105, in response to the control command, performs an ejection control based on printing data for each head 2. The printing data contains the image data and the on-paper flashing data. Note that each non-image dot is a dot formed between image dots, and is formed for the purpose of maintaining the ejection characteristics. Further, the controls by the conveyance controller 106 and the head controller 105 are synchronized with the signal from the paper sensor 142.

The control unit 100 includes a head protection control unit 104 as a structure for controlling a protecting operation performed after image formation. The protecting operation is an operation for preventing drying up of the meniscus at each ejection opening 11, and includes a humidifying operation and a capping operation. The head protection control unit 104 controls the cap moving unit 51 to cause the cap unit 50 to seal off the ejection face 2*a*. Further, the head protection control unit 104 controls the humidifier 55 to humidify inside the sealed space V1.

The following provides further details of the structure of the recording controller 120. As shown in FIG. 5A, the recording controller 120 includes an image dot formation unit 121 related to formation of image dots, and a non-image dot formation unit 122 related to formation of non-image dots. The image dot formation unit 121 generates an instruction to form an image dot on the sheet. This is performed based on the image data. The non-image dot formation unit 122 generates an instruction to form a non-image dot on the sheet. This is performed based on the on-paper flashing data. The non-image dot is sufficiently smaller than the image dot, and is hardly visible even if the dot is formed on the sheet.

Specifically, the non-image dot formation unit 122 makes references to image data for each of the ejection openings 11. Then, as the result of making reference, if a period of not forming an image dot exceeds a predetermined length in any of the ejection openings 11 the non-image dot formation unit 122 transmits a control command to the head controller 105 so as to form a non-image dot at least once within the period. The number of times the non-image dot is formed within this period is adjusted within a range that the quality of image formed on the sheet is not deteriorated. For example, suppose the image data contains data sets shown in FIG. 6, in relation to one ejection opening 11. In FIG. 6, data D1 and D2 are data sets corresponding to formation of an image dot. Each set of data C is data corresponding to non-formation of an image dot, i.e., formation of a blank space on the sheet P. In this case, the non-image dot formation unit 122 counts the number of sets of data C from data D1 to data D2. When the number counted exceeds a number corresponding to a predetermined length, one of the sets of data C is changed to data E corresponding to formation of a non-image dot. The data E corresponds to on-paper flashing data. Then a control command according to the changed data is transmitted to the head controller 105.

As described, the non-image dot is formed for the purpose of restraining deterioration of the ejection performance caused by drying up of the ink nearby the ejection opening 11. However, the non-image dots are unnecessary dots for image formation. If these dots are noticeable, the image quality is deteriorated. For this reason, the size and the number of non-image dots are limited, as described above. Therefore, formation of non-image dots alone may not sufficiently restrain deterioration of ejection performance caused by drying up of the ink.

To address this issue, the present embodiment is provided with a structure for extending a flashing operation, apart from formation of the non-image dots. As shown in FIG. 1, the control unit 100 includes, as a structure the controlling the flashing operation, a flashing controller 130, *a* rank information storage 101, and an ejection status obtaining unit 103.

The rank information storage 101 has rank information for adjusting conditions of flashing operation for each head 2. To perform controls taking into account the manufacturing error, the present embodiment adopts various pieces of rank information prescribing the level of errors. Of this, size information of the diameter of the ejection opening 11, which information is related to irregularity of the ejection characteristics, is used as rank information for adjusting flashing conditions. The size information contains information of deviance of the actual measurement value with respect to the designed value. The diameter of the ejection opening relates to the ejection characteristics, and also relates to how easily the ink dries up. This is because the diameter of the ejection opening relates to the planar dimension of an area of the ink exposed to the external air. The rank information is prescribed by the average value of the diameters of the ejection openings. Note that the diameters of the ejection openings are obtained as follows. Namely, an image of ejection openings is obtained by applying strobe light from the back surface of the plate on which ejection openings are formed, and taking a picture of the light having passed from the front surface side. By subjecting this image to a predetermined image process the diameters of the ejection openings are obtained.

Further, for each of the ejection openings 11, the ejection status obtaining unit 103 obtains an ink ejection status for the purpose of adjusting the conditions of the flashing operation for each head 2. This is because, the larger the number of ink ejections, the more difficult the ink is dried. As such, the needs for the flashing operation are relatively low. Specifically, the ejection status obtaining unit 103 monitors for each of the ejection openings 11, the control command for ink ejection generated by the recording controller 120. By doing so, the ejection status obtaining unit counts the number of dot formations for each ejection opening 11. This counting is performed for formation of image dots as well as formation of non-image dots. The result is transmitted to the flashing controller 130. The result having been transmitted is used when controlling calculation for determining the timing of the flashing operation, as hereinafter described.

In traditional art, the timing of the flashing operation is determined by determining whether or not the number of copies, the printing interval, or the like has net a predetermined condition. For example, the flashing operation is executed when the number of copies exceeds a predetermined number. Meanwhile, how easily the ink dries up depends on the printing interval t. When the printing interval t is short, the frequency of image formation increases, and so does the number of ink ejections. Therefore, the ink nearby the ejection openings 11 is hardly dried. To the contrary, when the printing interval t is long, the frequency of image formation is lowered. Therefore, the ink is easily dried.

Despite this fact, in the traditional art, the flashing operation is executed once the condition such as the number of copies or the like is net without variation. This means that the flashing operation is executed even if the printing interval t is short, and the ejection performance is not deteriorated. This results in wasting of the ink and the power. Further, when the printing interval t is long, the flashing operation may not be executed until the condition is met without variation, although the ejection performance is deteriorated. For this reason, the deterioration in the ejection performance is not suitably handled. Especially, in cases where the printing interval t is easily varied, e.g., when the interval varies every sheet, the traditional art will not be able to suitably handle the deterioration of the ejection performance.

In view of this, the present embodiment adopts a coefficient according to the printing interval t, for the purpose of suitably handle the sheet-by-sheet variation in the printing interval t. This coefficient is an evaluation value such that the greater the coefficient, the more easily the ejection performance is deteriorated. For example, the longer the printing interval t, the greater the coefficient. The coefficient is derived by using a function related to the printing interval t. This function is derived, for each environmental temperature and environmental humidity.

The following describes a method of deriving the function. First, a continuous printing test is conducted with respect to the printer 1. The printing interval t is fixed to a certain value, and the temperature and the humidity of the surrounding environment are changed in various ways. When the number of copies to be printed increases, the ejection characteristics vary and a change in the image quality becomes recognizable when a certain number of copies are printed. This number is set as a limit number of copies in which the image quality is maintained. Table 2 shows a relation between a combination of the temperature and the humidity and the limit number of m11 to m33.

TABLE 2

| | Humidity | | |
|---|---|---|---|
| Temperature | H1 to H2 | H2 to H3 | H3 to H4 |
| T1 to T2 | m11 | m12 | m13 |
| T2 to T3 | m21 | m22 | m23 |
| T3 to T4 | m31 | m32 | m33 |

Next, the similar test is conducted with another printing interval t. The results are shown in Table 3.

TABLE 3

| | Humidity | | |
|---|---|---|---|
| Temperature | H1 to H2 | H2 to H3 | H3 to H4 |
| T1 to T2 | n11 | n12 | n13 |
| T2 to T3 | n21 | n22 | n23 |
| T3 to T4 | n31 | n32 | n33 |

As described, the above described test is repetitively conducted with the printing interval t as a parameter. Then, a predetermined reference N is divided by the limit number to obtain the quotient. This quotient is the coefficient used in the present embodiment. Specifically, suppose the limit number under certain condition is 1000, and is 500 under another conditions. Where N=1000, the coefficient for the former condition is N/1000=1, and is N/500=2 for the latter condition. This shows that the latter condition deteriorates the ejection characteristics twice as fast as the former condition. Note that the predetermined reference N is used as a threshold for determining the timing for executing the flashing operation, as described later. The predetermined reference N is set as a value for a standard head 2 (hereinafter, standard design head) without any error relative to the designed values. Table 4 shows coefficients obtained by varying the printing interval t, for various combinations of the environmental temperature and the environmental humidity,

TABLE 4

| Temperature | Humidity | Printing interval A | Printing interval B | ... |
|---|---|---|---|---|
| T1 to T2 | H1 to H2 | N/m11 | N/n11 | ... |
| | H2 to H3 | N/m12 | N/n12 | ... |
| | H3 to H4 | N/m13 | N/n13 | ... |
| T2 to T3 | H1 to H2 | N/m21 | N/n21 | ... |
| | H2 to H3 | N/m22 | N/n22 | ... |
| | H3 to H4 | N/m23 | N/n23 | ... |
| T3 to T4 | H1 to H2 | N/m31 | N/n31 | ... |
| | H2 to H3 | N/m32 | N/n32 | ... |
| | H3 to H4 | N/m33 | N/n33 | ... |

Next, for each combination of the environmental temperature and the environmental humidity, the results in Table 4 are plotted in a graph. The transverse axis represents the printing interval, and the vertical axis represents the coefficient. The function for each combination is obtained by deriving an approximated curve which passes by the plotted points. The approximated curve may be a linear curve, or may be a non-linear curve.

Figure 7A:
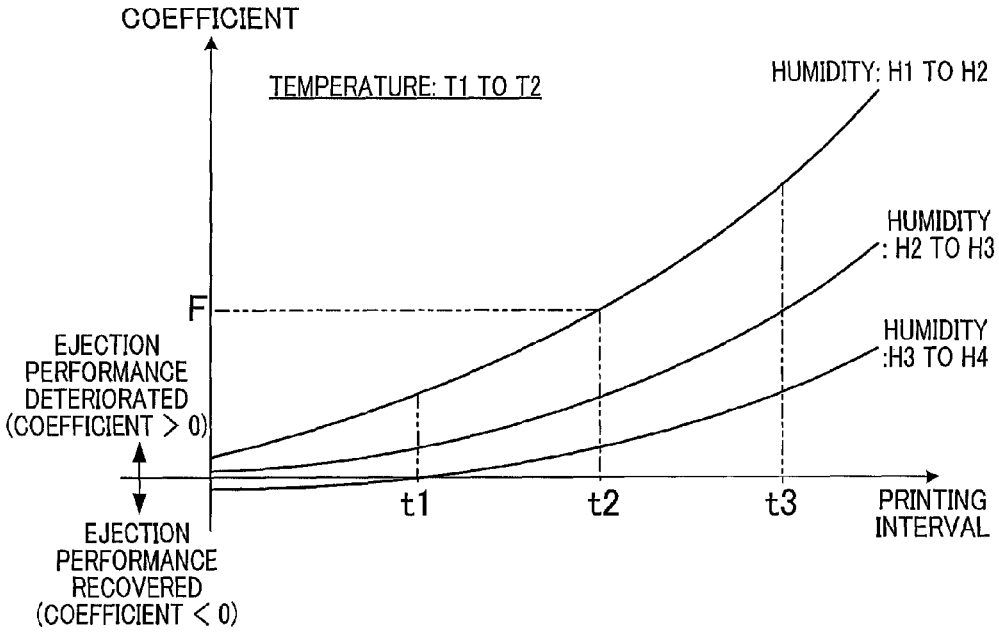
FIG. 7A is a graph showing a function for deriving a coefficient for use in addition.
Figure 7B:
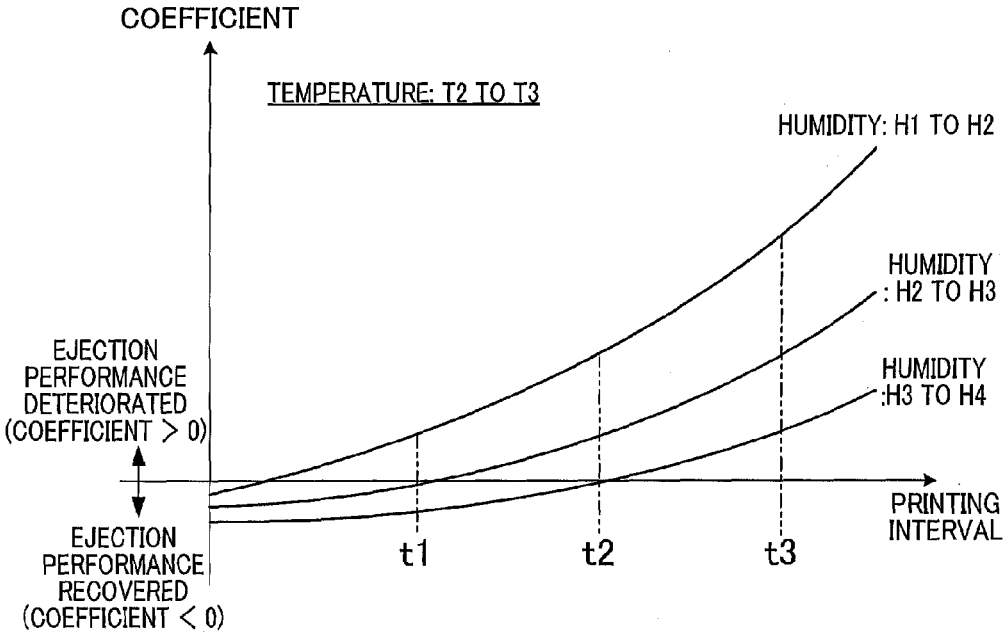
FIG. 7B shows a graph plotted under a different condition from FIG. 7A which is a graph showing: a function for deriving a coefficient for use in addition.

FIG. 7A is a graph showing functions obtained for the humidity within the ranges of H1 to H2, H2 to H3, and H3 to H4. The temperature is within the range of T1 to T2. FIG. 7B is a similar graph, but the range of the temperature is T2 to T3. Note that, the temperatures and the humidities have the following relations: T1>T2>T3>T4, and H1<H2<H3<H4. Further, the functions of FIG. 7A and FIG. 7B are derived as a non-linear curve.

The functions thus obtained have the following characteristics (1) to (4). As shown in FIG. 7A and FIG. 7B, (1) the value of function is increased monotonously with respect to the printing interval t. This means that, when the printing interval t increases, the effective number of ink ejections is reduced, thus facilitating deterioration in the characteristics. (2) When the environmental humidity is low with respect to the printing interval t, the value of function is increased. This means that, the lower the humidity is, the easier the ink will be dried. Thus, the ejection performance is easily deteriorated. (3) When the environmental temperature rises with respect to the printing interval t, the value of function is increased. This means that, the higher the temperature is, the easier the ink will be dried. Thus, the ejection performance is easily deteriorated. (4) Depending on conditions, the value of function becomes negative. In other words, the coefficient is a negative value. The positive coefficient means deterioration of the ejection performance, and the negative coefficient means recovery of the performance. The absolute value represents the level of variation. When the printing interval t is sufficiently short, the performance is not deteriorated, but may be even recovered.

Thus, when determining the timing for executing the flashing operation by using these functions, the print enforceable period which is a period up to the timing for executing the subsequent flashing operation is shortened with an increase in the printing interval t, with a decrease in the humidity, or with an increase in the temperature.

Figure 5B:
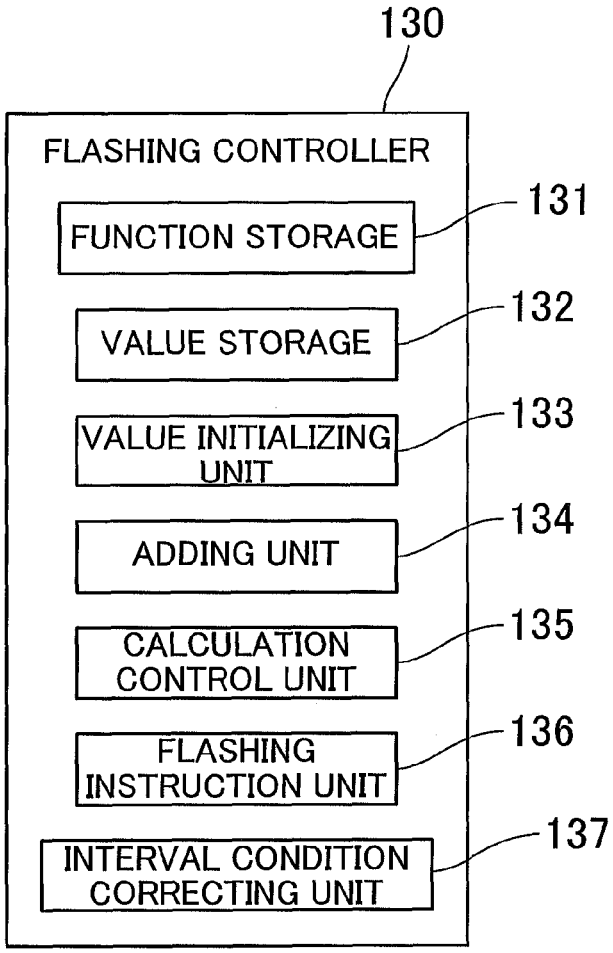
FIG. 5B is a block diagram showing detailed structure of a glassing controller show in FIG. 4.
Figure 6:
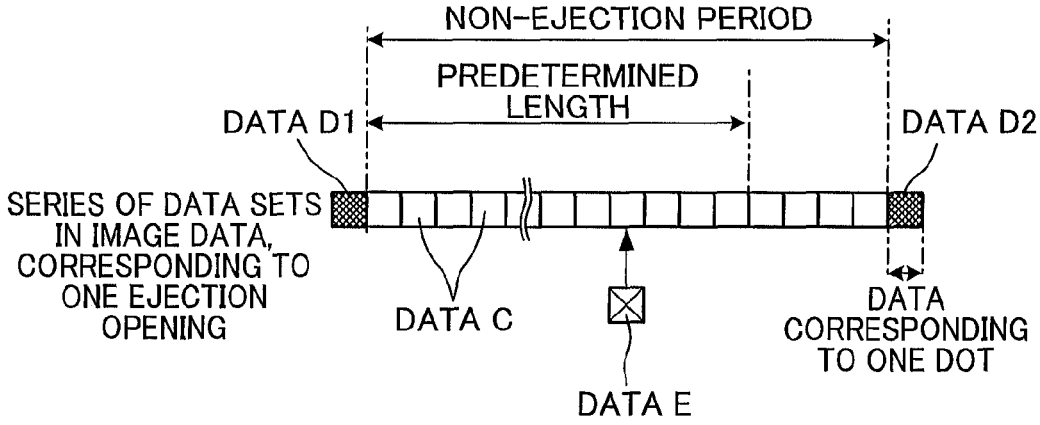
FIG. 6 shows a situation in which, where a data unit instructing formation of an image dot and a data unit instructing formation of no image dot are aliened, the latter data unit is changed to a data unit instructing formation of a non-image dot.

To execute the flashing operation using the functions thus obtained, the flashing controller 130 includes a function storage 131, a value storage 132, a value initializing unit 133, an adding unit 134, a calculation control unit 135, a flashing instruction unit 136, and an interval condition correcting unit 137, as shown in FIG. 5B.

The function storage 131 stores information indicative of the functions corresponding to those shown in FIG. 7A and FIG. 7B, in association with the environmental temperature and the environmental humidity. The value storage 132 stores a value for determining the timing for executing the flashing operation. The value initializing unit 133 initializes the value stored in the value storage 132. In other words, the value initializing unit 133 sets the value stored in the value storage 132 to 0 (zero). The adding unit 134 derives an addition value to be added to the value stored in the value storage 132 based on the information of function stored in the function storage 131, every time a sheet undergoes the image formation.

Next, the following describes an example of value addition by the adding unit 134. When executing the addition, the environment sensor 141 detects the environmental temperature and humidity. Based on the temperature and the humidity, the adding unit 134 obtains a corresponding function from the function storage 131, and obtains the printing interval t from the recording mode data stored in the mode storage 1. The adding unit 134 derives a coefficient from these two pieces of information, and adds the coefficient to the value in the value storage 132. For example, suppose the temperature is within the range of T1 to T2, and the humidity is within the range of H1 to H2, and the recording mode is B. In this case, the adding unit 134 obtains a function for the humidity H1 to H2 from the function storage 131, and obtains from the mode storage 111 the printing interval t t2 which corresponds to the recording mode B. Then, the adding unit 134 derives a coefficient value F (see FIG. 7A), and adds the coefficient to the value stored in the value storage 132.

The calculation control unit 135 controls the addition by the adding unit 134 and the initialization by the value initializing unit 133. These processes are executed based on the ink ejection status from the ejection opening H. The ejection status is the number of dots (hereinafter, formed dot count) to be formed by an ejection opening 11 on a single sheet. This information is output by the ejection status obtaining unit 103 as hereinabove mentioned. Every time a single sheet undergoes image formation, the calculation control unit 135 refers to the ejection statuses of all the ejection openings 11. Next, the calculation control unit 135 compares the formed dot count with a threshold. A and with the threshold. B (>threshold A).

When the formed dot count 10 smaller than the threshold A in relation to at least one ejection opening 11, the calculation control unit 135 causes the adding unit 134 to execute addition. When the formed dot count is not less than the threshold A for all the ejection openings, and is less than the threshold B for at least one ejection opening 11, the calculation control unit 135 causes the adding unit 134 to cancel the addition. This is because all the ejection openings 11 have a certain number of ink ejections, and deterioration in the characteristics hardly progresses. Further, when the formed dot count is not less than the threshold B for all of the ejection openings 11, the calculation control unit 135 causes the adding unit 134 to cancel the addition, and also causes the value initializing unit 133 to initialize the value of the value storage 132. This is because a sufficient number of ink ejections is ensured, which even recover the ejection performance. There is no need for executing the flashing operation.

For example, suppose an image is formed in longitudinally on an A4-size sheet with a resolution of 600 dpi in the present embodiment. Since the size in the longitudinal direction corresponds to approximately 7000 dots, the threshold A is set to 2000 dot, and the threshold B is set to 5000 dot.

The flashing instruction unit 136 determines whether a value stored in the value storage 132 exceeds the predetermined reference N. The value of the value storage 132 corresponds to the result of adding the coefficient. This coefficient is, as described hereinabove, a value obtained by dividing the reference N by a limit number of copies corresponding to the printing interval t. Therefore, the addition value exceeding the reference N means an image has been formed to the limit number of sheets or more. When the flashing instruction unit 136 determines that the value has exceeded the reference N, the flashing instruction unit 136 sets that point of exceeding as the timing for executing the flashing operation, if the image formation on a sheet is in process, the flashing instruction unit 136 instructs to hold conveyance of the subsequent sheet, after the image formation to the current sheet is completed and the sheet is output. A control command relating to this is output to the conveyance controller 106. This way, the area facing the heads 2, the area on which the ink is to be placed, is left without any sheet. The flashing instruction unit 136 then outputs an instruction to execute the flashing operation. A control command relating to this is transmitted to the head controller 105. Thus, a predetermined amount of ink is ejected towards the surface 8*a* of the conveyor belt 8 from all the ejection openings 11 on all the heads 2.

The interval condition correcting unit 137 corrects the predetermined reference N, based on data indicating the rank information stored in the rank information storage 101. The predetermined reference N is set for the standard design head, as hereinabove described. Meanwhile, when the size of the ink passage is different from that of the standard design head, how easily the ink is dried will be also different. In view of this, the interval condition correcting unit 137 corrects the predetermined reference N to a corrected value N', based on the rank information. When the rank information indicates that the ink is easily dried, the corrected value N' is set to be smaller than the reference N. When the rank information indicates that the ink is hardly dried, the corrected value N' is set to be greater than the reference N. The difference between N' and N is set according to the rank. The flashing instruction unit 136 determines the timing for executing the flashing operation, based on the corrected value N'.

After image formation of all the image data stored in the image data storage 102 is completed, the flashing controller 130 executes control to cause one more flashing operation before the cap moving unit 51 moves the cap unit 50. The flashing controller 130 refers to the value data stored at this point in the value storage 132. The flashing controller 130 sets the number of ink ejections at the time of flashing, based on the value indicated by the value data. The number of ejections increases with an increase in the value indicated by the value data is. But, the number of ejections is not more than the number of ejections at each flashing operation during the image formation, described above. The control command relating to this flashing operation is output to the head controller 105. After the ink ejection is completed, a signal indicating the completion of ink ejection is transmitted to the head protection control unit 104. The head protection control unit 104 starts driving the cap moving unit 51 and the humidifier 55, after receiving this signal.

As described, the flashing controller 130 determines the timing for executing the flashing operation using the functions having the above described characteristics (1) to (4). As such, the control by the flashing controller 130 has the following characteristics (a) to (d) corresponding to (1) to (4). (a) The longer the printing interval t is, the earlier the timing for executing the subsequent flashing operation. (b) The time intervals between flashing operations shorten with an increase in the printing interval t. (c) When the printing interval t is sufficiently short, the ejection performance is expected to be recovered. Therefore, the value indicated by the value data in the value storage 132 is reduced. (d) The timing for executing the subsequent flashing operation is made earlier with an increase in the environmental temperature, or with a decrease in the environmental humidity.

To efficiently execute the flashing operation, based particularly on the above (c), the present embodiment is structured as described below. The recording mode management unit 110 has an order changing unit 113. The order changing unit 113 changes the order data indicative of the order of the recording modes stored in the mode order storage 112. When a plurality of sets of print job data are supplied from an external source, the mode order storage 112 stores the order data indicating the order of the recording modes having been received. The order changing unit 113 changes the order so that the mode with a smaller printing interval t is brought to the front, and the mode with a smaller printing interval t and the mode with a larger printing interval t are alternated as much as possible.

Figure 8A:
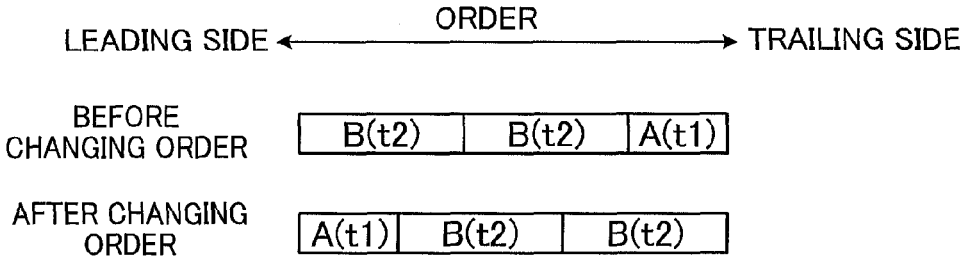
FIG. 8A shows an order of recording modes before and after a change.
Figure 8B:
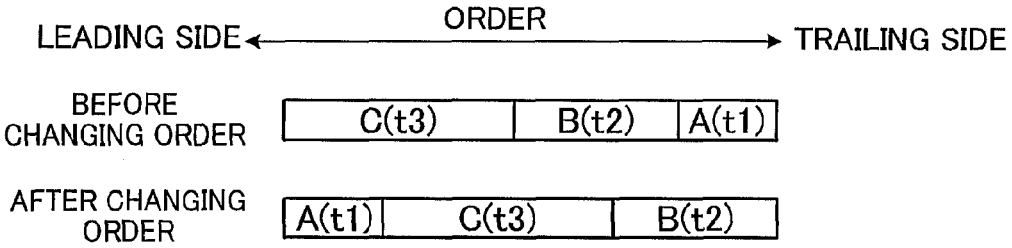
FIG. 8B shows an order of recording modes before and after a change.

For example, as shown in FIG. 8A, suppose the order of three recording modes is B→B→A. This order in the printing interval t is t2→t2→t1. In this case, the order changing unit 113 changes the order of the recording mode so that the recording mode A precedes the two recording modes B2. Further, as shown in FIG. 8B, suppose the order of three recording modes is C→B→A. This order in the printing interval t is t3→t2→t1. In this case, the order changing unit 113 changes the order of the recording mode so that the recording mode A precedes the recording modes C and B. As the result, the recording modes are alternately aligned in the order of a smaller printing interval t (t1)→ a larger printing interval t (t3)→ a smaller printing interval t (t2).

As shown in FIG. 7A and FIG. 7B, the functions used in the present embodiment includes a function such that a negative coefficient is resulted when the printing interval t is sufficiently small. Accordingly, the chance of having the ejection performance recovered through image formation increases with a decrease in the printing interval t. When the order is changed so that the image formation with a small printing interval is executed before the image formation with a large printing interval, the latter image formation is executed with good ejection characteristics. As the result, as compared with the order before the change, it is more likely that the flashing operation may not be needed. Further, when the order is changed so that the image formation with a small printing interval and the image formation with a large printing interval are alternated, the ejection performance is more likely to be recovered before the image formation with a large printing interval. Therefore, it will be more likely that the flashing operation may not be needed as a whole.

Figure 9:
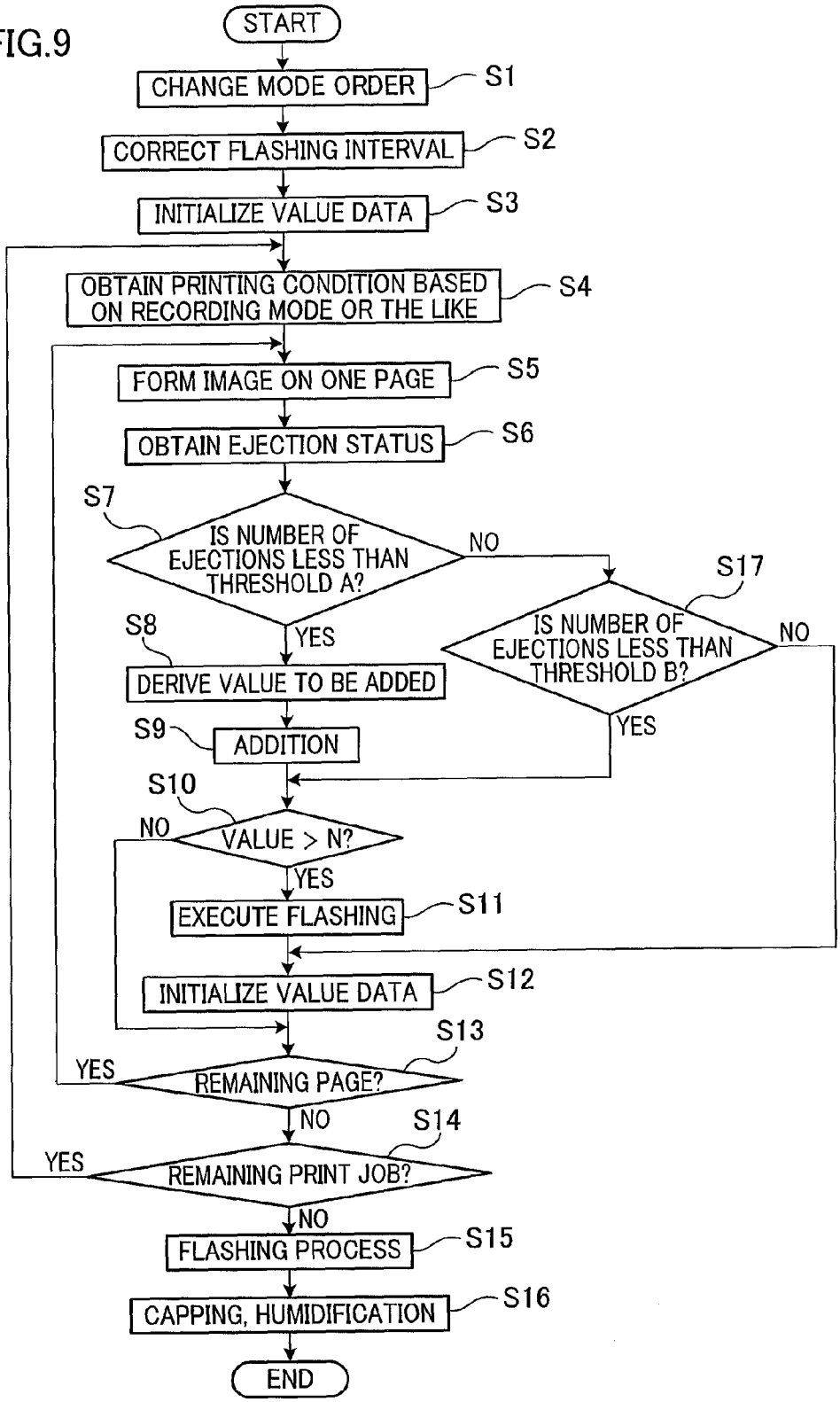
FIG. 9 is a flowchart showing a series of steps of a recording process and a flashing control process.

The following describes with reference to FIG. 9 a series of process steps from supplying of the print job data to protecting operation. First, in S1, the order changing unit 113 changes the order data stored in the mode order storage 112 which indicates the order of the recording modes so that the mode with a small printing interval is brought to the front. Then, the interval condition correcting unit 137 corrects the predetermined reference N to serve as the reference for determining the timing for executing the flashing operation, based on the rank information stored in the rank information storage 101 (S2). When the predetermined reference N is corrected to the corrected value N', the corrected value N' is used in the following, in place of the predetermined reference N.

Next, the value initializing unit 133 initializes the value data of the value storage 132 (S3). In S4 and thereafter, the image formation is executed in the order indicated by the order data stored in the mode order storage 112. First, the recording controller 120 obtains printing conditions such as the printing interval, the type of sheet, and the number of sheets, based on the condition data stored in the mode storage 111 (S4). Based on the printing conditions obtained, the recording controller 120 transmits control commands to the head controller 105 and the conveyance controller 106 so that an image based on the image data in the image data storage 102 is formed on one sheet which is the sheet P or sheet P' (S5).

Next, the ejection status obtaining unit 103 obtains the ejection status of each ejection opening 11 from the recording controller 120 (S6). When the calculation control unit 135 determines that the number of ejections is less than the threshold A in relation to at least one ejection opening 11 (S7, Yes), the adding unit 134 derives the addition value (S8) and updates the value data in the value storage 132 to a value after the addition value is added (S9). On the other hand. In S7, when the number of ejections is determined as to be equal to or more than the threshold A in relation to all the ejection openings 11 (S7, No), the calculation control unit 135 determines whether the number of ejections in relation to any of the ejection openings 11 is less than the threshold B (S17). When the number of ejections is determined as to be less than the threshold B in relation to at least one ejection opening 11 (S17, Yes), the calculation control unit 135 proceeds to S10 without causing the adding unit 134 to execute the addition. On the other hand, when the number of ejections is determined as to be not less than the threshold B in relation to all the ejection openings 11 (S17, No), the calculation control unit 135 proceeds to S12. In S12, the value initializing unit 133 initializes the value data of the value storage 132.

In S10, the flashing instruction unit 136 determines whether or not the value indicated by the value data of the value storage 132 has exceeded N (S10). When the value is determined as to have exceeded (S10, Yes), a control command instructing the flashing operation is transmitted to the head controller 105 and the conveyance controller 106 S11). The value initializing unit 133 then initializes the value data of the value storage 132 (S12). On the other hand, when the value indicated by the value data of the value storage 132 is determined as to be not more than N (S10, No), the process proceeds to S13.

In S13, the recording controller 20 determines whether there is a remaining page for image formation in the current print job. If there is a remaining page (S13, Yes), the process returns to S5. When it is determined there is no more pages for image formation (S13, No), the step proceeds to S14. Next, the recording controller 120 determines whether or not there is remaining print job data for image formation (S14). If there is (S14, Yes), the process returns to S4. If it is determined that there is no more print job data for image formation (S14, No), the process proceeds to S15. Then, the flashing controller 130 transmits a control command to the head controller 105 so that flashing is executed based on the value data stored in the value storage 132 (S15). After that, based on a signal transmitted from the flashing controller 130, the head protection control unit 104 drives the cap moving unit S1 and the humidifier 55 to cap the heads 2 and execute humidification of the sealed space V1 (S16).

In the present embodiment, the coefficient to be added by the adding unit 134 decreases with a decrease in the printing interval. Therefore, image formation is performed on many sheets before the value indicated by the value data of the value storage 132 reaches the predetermined, reference N. Therefore, when the printing interval is small and the image quality is unlikely to be deteriorated, the subsequent flashing operation is executed after performing image formation many times. This prevents wasting of the liquid and power caused by executing unnecessary flashing operation. To the contrary, the larger the printing interval, the less the number of times image formation is performed before the subsequent flashing operation is executed. Thus a suitable number of flashing operations is ensured, based on how easily the ejection performance deteriorates. Further, in the present embodiment, the time interval before the subsequent flashing operation increases with a decrease in the printing interval, decreases with an increase in the printing interval. Thus, unnecessary flashing operation is more reliably avoided, while ensuring the necessary flashing operation based on how easily the ejection performance deteriorates.

Further, in the present embodiment, when the flashing operation is executed after all the image formation is completed, the flashing operation is executed so as to eject an amount of ink according to the value data stored in the value storage 132 at the moment. This prevents wasting of liquid or power associated with the flashing operation, while ensuring a necessary amount of ejection for the flashing operation.

Further, in the present embodiment, the calculation control unit 135 determines whether to cause the adding unit 134 to execute addition, based on the ejection status of each ejection opening 11. For example, the addition is not executed when a large number of ink ejections are executed (see S7, No of FIG. 9). Therefore, it takes a long time before the subsequent flashing operation is executed, and unnecessary flashing operation is avoided. Further, when the number of ink ejections is even larger (see S17, No of FIG. 9), the value data of the value storage 132 is initialized. This effectively prevents unnecessary flashing operation.

Figure 10:
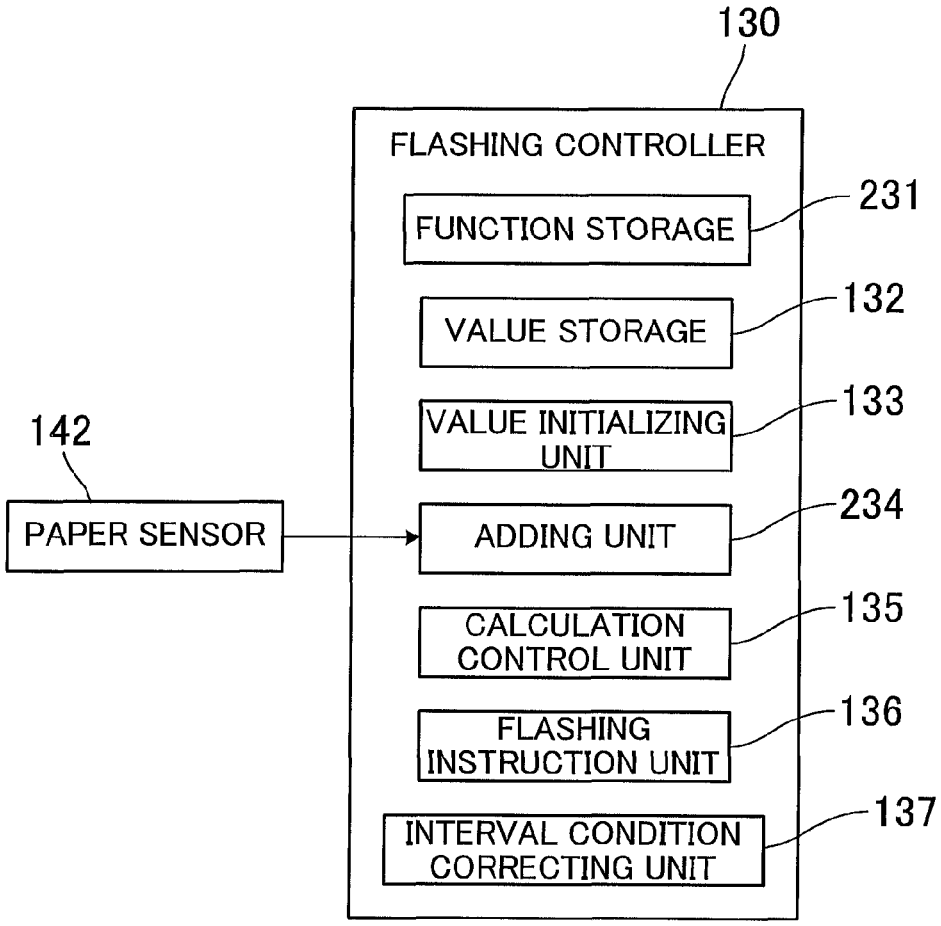
FIG. 10 is a block diagram showing a control system related to a second embodiment.

The following describes a second embodiment of the present invention, with reference to FIG. 10. The second embodiment is different from the first embodiment only in the structures of the function storage 231 and the adding unit 234. Therefore, the following description deals mainly with these structures, and the descriptions for other structures are omitted. The function storage 231 stores data indicating a function for a combination of the type of sheet, the environmental temperature, and the environmental humidity. Specifically; the function storage 231 stores data indicating a function for a sheet P, and that for a sheet P' which is longer than the sheet P in the longitudinal direction (sheet conveyance direction). Either function has the following characteristics (5) and (6), in addition to the above described characteristics (1) to (4). (5) The coefficient for the same printing interval t increases with a decrease in the size of the sheet relative to the sheet conveyance direction. This is for the filet that, where the sheets are conveyed at the same printing interval t, the one which is shorter will be subjected to less ink ejections than the one which is longer. (6) There is given a coefficient such that, the longer the sheet relative to the sheet conveyance direction, the longer the time interval before the flashing operation for the same printing interval t. This is for the fact that, where the sheets are conveyed with the same printing interval t, an increase in the length of the sheet will increase the number of ink ejections thereto and delays the timing where the flashing operation becomes necessary.

The adding unit 234 obtains the printing interval from the detection result of the paper sensor 142, unlike the first embodiment which obtains the printing interval from the recording mode. Every time the paper sensor 112 outputs a sheet leading end detection signal, the adding unit 234 derives the time interval between the point of outputting a the previous signal and the point of outputting the current signal. Next, the adding unit 234 obtains, from the function storage 231, data indicating a function associated with the sheet type data stored in the mode storage 111. Next, the adding unit 234 derives a coefficient for the time interval, based on the data indicating the function obtained. Then, the adding unit 234 multiplies the coefficient thus derived by the time interval, and adds the product to the value indicated by the value data in the value storage 132.

With the second embodiment, the flashing operation is executed based on they interval which is obtained based on the detection result of the paper sensor 142. Further, the coefficient is set based on the type of sheet so that, for example the time interval before the flashing operation is longer with an increase in the length of the sheet and with an increase in the number of ink ejections. Therefore, unnecessary flashing operation is suitably avoided for the length of the sheet, while appropriately ensuring the necessary flashing operation.

Figure 11:
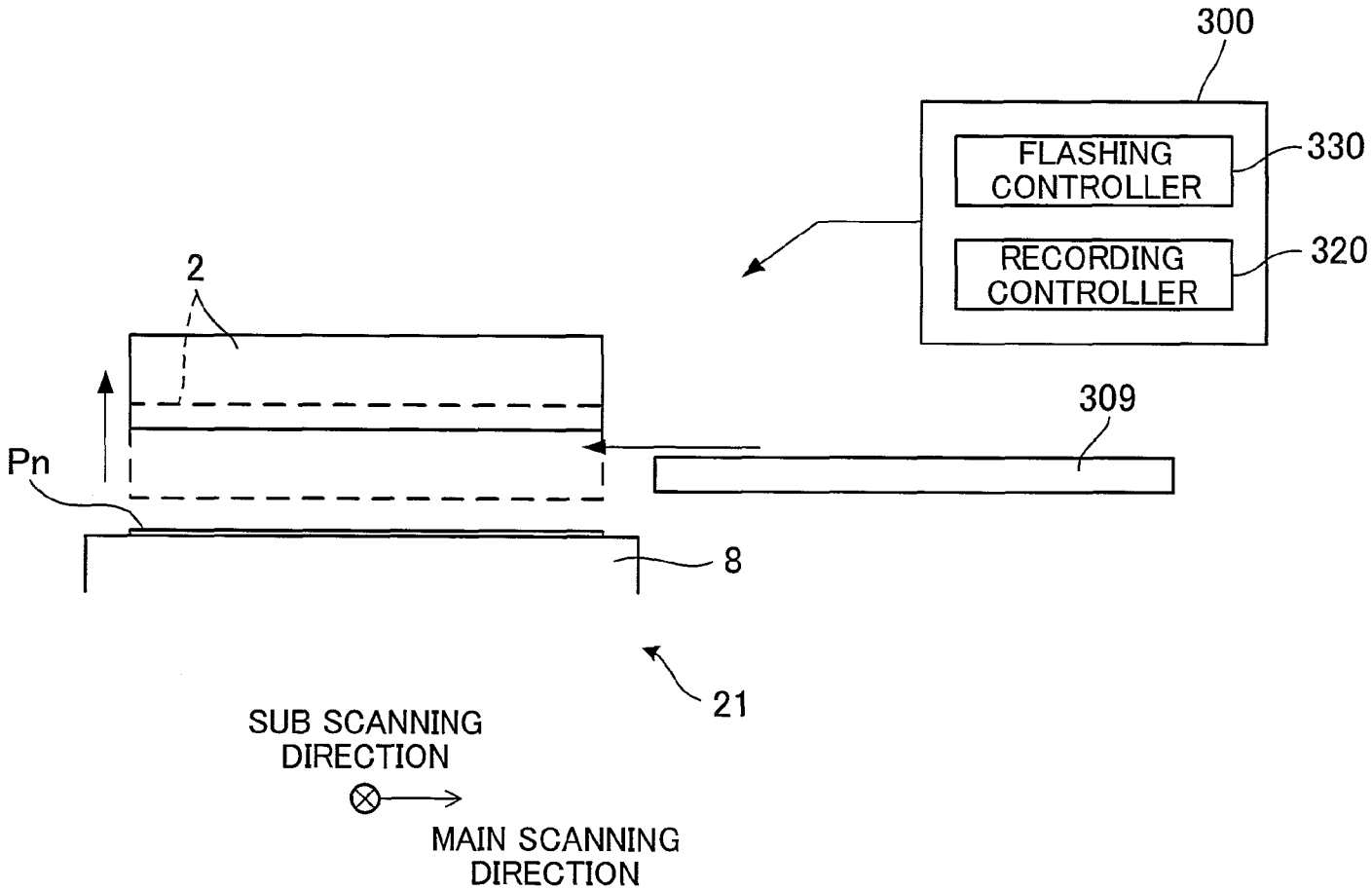
FIG. 11 is a side view indicating a structure of a periphery of a head related to a third embodiment.

The following describes a third embodiment of the present invention, with reference to FIG. 11. The following description mainly deals with the difference from the first embodiment and the second embodiment, and omits the description for the other structures. The third embodiment is intended, for a case of using a rolled paper Pn which is continuous relative to the sheet conveyance direction, instead of the sheet P or the sheet P' which is cut out in a predetermined size. In the third embodiment, a recording controller 320 provided to the control unit 300 controls the heads 2 so that the time interval between image formation of one page and that of another page is a predetermined length. The recording controller 320 also controls the conveyance unit 21 or the like so that the rolled, paper Pn is conveyed at the speed corresponding to the time interval. Further, the flashing controller 330 determines timing for executing the flashing operation by using a function based on the time interval, as in the case of the first embodiment. In this case, it is possible to use the function used in the first embodiment as it is.

On the other hand, unlike the sheet P or the like the rolled paper Pn is continuous. Therefore, it is difficult to realize the state where the rolled paper Pn does not exist under the heads 2. In view of this, the present embodiment adopts a platen 309 for receiving ink ejected from the heads 2 in the flashing operation. The platen 309 is capable of moving in the main scanning direction between a position isolated from the heads 2 relative to the main scanning direction (position in FIG. 11) and a position under the heads 2. The movement of the platen 309 is controlled by the flashing controller 330.

In the flashing operation, the flashing controller 330 first controls the conveyance unit 21 or the like to temporarily stop the conveyance of the rolled paper Pn. Next, the flashing controller 330 controls the head moving unit 32 to move the heads 2 from the record position to the retracted position. The record position is a position indicated by a broken line in FIG. 11. The retracted position is a position indicated by a solid line in FIG. 11. Next, the flashing controller 330 moves the platen 309 disposed in the position isolated from the heads 2 relative to the main scanning direction to the position below the heads 2. The flashing controller 330 then controls the heads 2 to cause ejection of a predetermined amount of ink, while the platen 309 is positioned below the heads 2. When the flashing operation is completed, the flashing controller 330 reverses the above flow, and brings back the heads 2 and the platen 309 to the positions where they were before the flashing. The recording controller 320 then resumes control of the image formation.

It is possible to adopt a maintenance unit which maintains the ejection face 2*a* of each head 2, instead of adopting the platen 309. It is further possible to provide a cutter for cutting the rolled paper Pn in the upstream from the heads 2 relative to the sheet conveyance direction. With this cutter, it is possible to achieve the state where no rolled paper Pn is disposed below the heads 2, by cutting the rolled paper Pn at the time of executing the flashing operation, and outputting the downstream side of the rolled paper Pn on which image formation has been completed.

In an alternative form, the maintenance unit includes a platen, and an ink receiver which is disposed to face the ejection face 2*a* across the platen. The ink receiver is for example sponge or the like. During printing operation, the platen is disposed to face the ejection face 2*a*, and supports the rolled paper Pn conveyed. The rolled paper 10 is conveyed by two pairs of conveyance rollers which sandwiches the platen relative to the conveyance direction. The platen has a turning axis parallel to the conveyance rollers, nearby these rollers. In the flashing operation, the platen is turned about the axis and move away from the ejection face 2*a*. At this time, the ink receiver faces the ejection face 2*a* across a space, and is moved towards the ejection face 2*a* so as to be a predetermined distance away from the ejection face 2*a*. The flashing operation is executed during this state. After the flashing complete, the ink receiver moves away from the ejection face 2*a*, and the platen is brought back to the position parallel to the ejection face 2*a*. This structure enables reduction of time taken to complete the flashing process, as compared with the structure in which the platen is disposed beside the heads 2.

Thus, preferable embodiments of the present invention are described. It should however go without saying that the present invention is not limited to the embodiments described above, and may be altered in various ways.

For example, in the above embodiments, the functions are set so that the time intervals between flashing operations increase with a decrease in the printing interval (see above (b)). However, at least a part of the functions may be set so that the coefficient given becomes small when the printing interval is shortened, but that the resulting time interval before the flashing operation is not changed. This is for the fact that, for example, when a function draws an approximately linear curb in relation to the printing intervals, i.e., an approximated straight line, and the coefficient is proportional to the printing interval in at least part of the curve.

Further, the above embodiment deals with a case where the coefficient derived by using a function is added. However, the present invention may be applicable to a case where the coefficient derived is multiplied. For example, the flashing operation is executed, when the value resulting from the multiplication exceeds the predetermined reference. In this case, the function that gives the coefficient draws a curb that monotonously increase in relation to the printing intervals. Further, the range in which the coefficient exceeds 1 is the range in which the ejection performance deteriorates, and the range in which the coefficient is less than 1 is the range in which the ejection performance recovers.

The liquid ejection apparatus related to the present invention is applicable to not only printers, but also facsimiles, photocopiers, or the like. The number of heads in the liquid ejection apparatus is not limited four, and may be any given number of one or more. Each head is not limited to a line head, and may be a serial type. Further, the heads of the present invention may eject a liquid other than ink.

What is claimed is:

1. A liquid ejection apparatus, comprising:

a liquid ejection head which ejects a liquid;

a conveyor which conveys one or more recording media along a conveyance path;

a recording controller which causes the conveyor to convey the recording media, and executes control for ejecting the liquid from the liquid ejection head so that an image is formed on the recording media based on image data; and a flashing controller which executes flashing control for causing the conveyor to temporarily stop conveyance of the recording media, and for causing liquid ejection from the liquid ejection head, based on drive data which is not related to image formation;

wherein the flashing controller determines timing for executing a subsequent flashing control so that, within a print enforceable period between one flashing control and the subsequent flashing control, the number of pages subjected to image formation based on image data increases with a decrease in a time interval between image formation on one page and that on another page, wherein the flashing controller includes:

a value storage which stores value data for determining timing for executing the flashing control, an initializer which initializes the value data, and a calculator which adds or multiplies a value to or by the value data stored in the value storage every time image formation on one page is completed, wherein the value to be added or multiplied by the value data is decreased with a decrease in a time interval between image formation on a previous page and that on the current page; and when a value indicated by the value data stored in the value storage exceeds a threshold, the flashing controller executes the flashing control and the initializer initializes the value data.

2. The liquid ejection apparatus according to claim 1, wherein the flashing controller increases the print enforceable period with a decrease in the time interval between image formation on one page and that on another page.

3. The liquid ejection apparatus according to claim 1, wherein:

the flashing controller includes a function information storage which stores information indicative of a function relating to the time interval; and the calculator derives the value to be added or multiplied based on the function.

4. The liquid ejection apparatus according to claim 1, further comprising:

a cap which is selectively disposed in a sealing position for sealing an ejection face of the liquid ejection head which ejects the liquid and an isolated position which is isolated from the ejection face;

a cap transferring unit which moves the cap from the isolated position to the sealing position after the recording controller completes all image formations, wherein the flashing controller executes a flashing control after the recording controller completes all image formations and before the cap transferring unit moves the cap from the isolated position to the sealing position, and the flashing control causes ejection of the liquid in such a manner that the amount of liquid to be ejected increases with an increase in the value stored in the value storage.

5. The liquid ejection apparatus according to claim 1, wherein:

the liquid ejection head includes a plurality of ejection openings which eject the liquid, and an ejection status obtainer which obtains a liquid ejection status based on the image data, for each of the ejection openings; and the calculator determines whether to execute addition or multiplication with respect to the value data stored in the value storage, based on the liquid ejection status obtained by the ejection status obtainer.

6. The liquid ejection apparatus according to claim 5, wherein:

the calculator performs no addition or multiplication, when every one of the ejection openings forms dots on a recording medium in number not less than a first threshold, and when at least one of the ejection openings form dots on a recording medium in number less than a second threshold which is greater than the first threshold;

the initializer initializes the value data, when every one of the ejection openings form dots on a recording medium in number not less than the second threshold.

7. The liquid ejection apparatus according to claim 1, further comprising:

a mode data storage which stores at least one set of recording mode data which is associated with the time interval, wherein the recording controller causes conveyance of the recording media at a speed based on the time interval associated with the at least one set of recording mode data stored in the mode data storage, and performs image formation on the recording media conveyed at the time interval, by ejecting the liquid from the liquid ejection head.

8. The liquid ejection apparatus according to claim 7, wherein:

the flashing controller sets the print enforceable period so that the period is increased with a decrease in the time interval associated with the at least one set of recording mode data stored in the mode data storage.

9. The liquid ejection apparatus according to claim 7, further comprising:

an order data storage which, when the mode data storage stores at least one set of recording mode data including a plurality of sets of recording mode data, stores order data indicating an order of the plurality of sets of recording mode data;

an order data changer which changes the order data stored in the order data storage, wherein the recording controller causes conveyance of the recording media at the time interval associated with each of the sets of the recording mode data stored in the mode data storage, in an order indicated by the order data stored in the order data storage; and the order data changer changes the order data to data indicating that one of the sets of recording mode data occurring before another one of the sets of recording mode data is associated with a shorter time interval than that associated with the other one of the sets of the recording mode data.

10. The liquid ejection apparatus according to claim 9, wherein:

the order data changer changes the order data to data indicating that one of the sets of recording mode data occurring before another one of the sets of recording mode data is associated with a shorter time interval than that associated with the other one of the sets of the recording mode data, so that the recording controller alternates control for conveying the recording media at a speed corresponding to a short time interval and control for conveying the recording media at a speed corresponding to a long time interval.

11. The liquid ejection apparatus according to claim 1, wherein:

the liquid ejection head includes a plurality of ejection openings which eject the liquid, the recording controller includes an image dot generating controller which controls the liquid ejection head to form image dots structuring a desirable image on a recording medium and a non-image dot generating controller which controls the liquid ejection head to form on the recording medium non-image dots which are not image dots structuring the desirable image;

the non-image dot generating controller causes ejection of the liquid for a non-image dot from an ejection opening of the liquid ejection head, whose non-ejection period which is a period without ejection of the liquid for image dots exceeds a predetermined length.

12. The liquid ejection apparatus according to claim 1, wherein:

the liquid ejection head includes a plurality of ejection openings which eject the liquid;

the apparatus further comprises a rank information data storage which stores rank information corresponding to the size of passages including a diameter the ejection openings;

the flashing controller sets the print enforceable period so that the period increases with a decrease in the diameter of the ejection openings associated with the rank information stored in the rank information data storage.

13. The liquid ejection apparatus according to claim 1, wherein:

the flashing controller includes a timing obtainer which obtains the timing at which a recording medium passes a predetermined position, and derives a time interval based on the timing obtained by the timing obtainer.

14. The liquid ejection apparatus according to claim 13, further comprising:

a media supplier which supplies to the conveyor a plurality of types of recording media, each of the types having a length different from that of another type, relative to the conveyance direction along the conveyance path, wherein the conveyor conveys the plurality of types of recording media so that each of the recording media passes the predetermined position at timing such that the time interval is constant, the flashing controller sets the print enforceable period so that the period is increased with an increase in the size of the recording medium relative to the conveyance direction.

15. A liquid ejection apparatus, comprising:

an ejection head which ejects ink droplets;

a paper sensor which detects a leading end of a sheet on which an image is to be formed;

a conveyance mechanism which conveys the sheet from a predetermined position where the paper sensor is disposed to an image formation area facing the ejection head; and a control unit including a recording controller which synchronizes conveyance of the sheet by the conveyance mechanism with ejection of ink from the ejection head, based on a signal from the paper sensor, and a flashing controller which performs flashing control to temporarily stop the conveyance of the sheet by the conveyance mechanism, and then eject ink from the ejection head while no sheet is disposed in a position where ink will be placed, wherein the recording controller causes the conveyance mechanism to successively convey a plurality of the sheets, and causes image formation on each sheet by ejecting ink from the ejection head based on image data, and every time the paper sensor detects the leading end of a sheet, the flashing controller derives a product by multiplying a time interval between the sheet and a previous sheet having passed the predetermined position by a coefficient corresponding to the time interval, which is set so as to decrease with a decrease in the time interval, performs addition using the product thus derived, and performs flashing control when added value resulting from the addition of the product exceeds a threshold.

16. The liquid ejection apparatus according to claim 15, wherein:

when a value resulting from the addition of the products exceeds a threshold, the flashing controller initializes the value resulting from the addition.

17. The liquid ejection apparatus according to claim 15, wherein:

the flashing controller sets a print enforceable period between one flashing control and a subsequent flashing control so that the period increases with a decrease in the time interval.

* * * * *